US010332330B2

(12) United States Patent
Ylamas

(10) Patent No.: US 10,332,330 B2
(45) Date of Patent: Jun. 25, 2019

(54) RAFFLE DEVICE

(71) Applicant: Ruy Alvarenga Ylamas, Joinville (BR)

(72) Inventor: Ruy Alvarenga Ylamas, Joinville (BR)

( * ) Notice: Subject to any disclaimer, the term of this patent is extended or adjusted under 35 U.S.C. 154(b) by 0 days.

(21) Appl. No.: 15/455,349

(22) Filed: Mar. 10, 2017

(65) Prior Publication Data

US 2017/0263069 A1 Sep. 14, 2017

(30) Foreign Application Priority Data

Mar. 11, 2016 (BR) ..... 1020160055130

(51) Int. Cl.

| | |
|---|---|
| ***A63F 7/04*** | (2006.01) |
| ***G07C 15/00*** | (2006.01) |
| ***G07F 17/32*** | (2006.01) |
| ***A63F 9/00*** | (2006.01) |
| ***A63F 3/08*** | (2006.01) |

(52) U.S. Cl.

CPC ..... *G07C 15/005* (2013.01); *A63F 3/081* (2013.01); *A63F 9/0079* (2013.01); *G07F 17/3255* (2013.01); *A63F 2009/0081* (2013.01); *A63F 2009/0087* (2013.01); *A63F 2250/22* (2013.01)

(58) Field of Classification Search

CPC ..... A63F 7/04
USPC ..... 273/144 R
See application file for complete search history.

(56) References Cited

U.S. PATENT DOCUMENTS 2,175,197 A * 10/1939 Kent, Jr. ..... B63B 35/73 138/103
2,268,827 A * 1/1942 Gabriel ..... A63B 26/003 384/419
3,106,395 A * 10/1963 Birkenbeul ..... A61H 15/00 482/132
3,193,286 A * 7/1965 Sitter ..... A63B 26/003 172/537
3,845,952 A * 11/1974 McKinney ..... A63B 26/003 472/127
4,877,246 A * 10/1989 Kropkowski ..... A63F 7/048 193/17
4,974,847 A * 12/1990 Donahue ..... A63F 7/048 273/144 A
5,018,614 A * 5/1991 Ruckert ..... B65H 3/042 194/236

(Continued)

*Primary Examiner* — John E Simms, Jr.
*Assistant Examiner* — Dolores Collins
(74) *Attorney, Agent, or Firm* — Li & Cai Intellectual Property (USA) office

(57) ABSTRACT

A device used in marketing contests, particularly for the drawing of tickets which are put into a rotating raffle drum (G), and whose main purpose is to provide a dynamic and automated device that, advantageously, allows feeding of tickets even when the rotating drum is moving, enables constant and uniform shuffling of said tickets, thus ensuring randomness of the drawing with greater safety and ease and, at the same time, provides public entertainment. Said raffle device (E) comprises a rotating raffle drum (G), a stand (S), a rotation mechanism (R), a ticket feeding device (D), a compressed air power unit (C) and a power, command and control board (Q), including an electronic control unit (not depicted) such as a PLC. Device (E) may further comprise a ticket swirling mechanism (T) interconnected to a compressed air power unit (C) and a lighting system (not depicted) conveniently associated with the rotating drum (G).

20 Claims, 4 Drawing Sheets

(56) References Cited

U.S. PATENT DOCUMENTS

| | | | | | |
|---|---|---|---|---|---|
| 5,197,736 | A * | 3/1993 | Backus | A63F 3/06 | 273/142 J |
| 5,419,557 | A * | 5/1995 | Kirkland | A63F 7/048 | 273/144 A |
| 5,755,369 | A * | 5/1998 | Holmes | B26F 3/002 | 206/214 |
| 7,037,194 | B2 * | 5/2006 | Seelig | G07F 17/32 | 273/138.1 |
| 7,090,578 | B2 * | 8/2006 | Anderson | A63F 3/081 | 273/139 |
| 8,262,452 | B2 * | 9/2012 | Okuaki | G07F 17/3297 | 273/138.1 |
| 8,262,453 | B2 * | 9/2012 | Jubinville | G07F 17/329 | 463/17 |
| 2004/0082377 | A1 * | 4/2004 | Seelig | G07F 17/32 | 463/17 |
| 2004/0254008 | A1 * | 12/2004 | Anderson | A63F 3/081 | 463/17 |

* cited by examiner

RAFFLE DEVICE

The present invention relates to a device used in marketing contests, particularly for the drawing of tickets which are put into a rotating raffle drum, and whose main purpose is to provide a dynamic and automated device that, advantageously, allows feeding of tickets even when the rotating drum is moving, enables constant and uniform shuffling of said tickets, thus ensuring randomness of the drawing with greater safety and ease and, at the same time, provides public entertainment.

BACKGROUND OF THE INVENTION

One of the most common ways used by businesses to draw consumers' attention is the drawing of raffles. Such marketing tool is used, in short, to raise sales in a given period of time, mainly in special retail dates such as Mother's Day, Father's Day, Valentine's and Christmas.

That way, prizes are offered to customers in exchange for the consumption of products and services. In a conventional raffle, there is a minimum amount for consumption that is worth a ticket to be drawn at a specific date; the ticket includes the customer's contact information or any other kind of identification that qualifies the person for said raffle.

Once the customer is provided a ticket for each minimum amount spent, said ticket should be put into a raffle drum. Later on, after completion of the promotion, one lucky customer is to be randomly picked out, usually with the presence of an audience and an independent auditor to provide exposure to the event and to make it legal, as well as to properly award the prize to the holder of the drawn ticket.

PRIOR ART

Several devices used for conducting raffles generally used in advertising events are known, which are provided with a drum or a cage receiving on its inside numbered balls, the drum or cage being attached to a stand to raise it from the floor. Those devices make it possible to conduct the raffle by manually rotating drum or cage to shuffle the balls contained inside, the drawn balls being released through a proper opening.

An example of this kind of device is disclosed by the Brazilian patent document PI 9104267-4, filed on Sep. 30, 1991, originally titled "IMPROVEMENT IN RAFFLE CAGE", which describes a device intended to be used in drawings and provided with a stand to lift a cage. Said cage comprises a concave collection hopper that enables a ball to be individually drawn at random; the ball is then dropped into a chute attached to the frame. Also to ensure randomness, cage is provided with a handle to turn thereof and shuffle the balls.

Disadvantageously, though, configuration of said device allows the use of balls only, restricting its use in games such as bingos or lottery draws which aim a number combination as a final result. Further disadvantageously, the user has to manually spin the cage with a handle to shuffle the balls.

Another example of an existing device is the one for the drawing of tickets which, thanks to improved technology, came to be more used due to the easy printing of said tickets resulting in the reduction of scams involving high value prizes. Such device is made up by a properly shaped drum to ensure full storage of tickets, said drum being provided with a slot with a hatch through which the tickets are inserted and released and which, disadvantageously, allows tickets to be put into the drum only when it is stationary.

In such types of devices, shuffling is made possible by the rotational movement of the drum through a manual handle, or the drum is manually rotated to shuffle the tickets using the gravity action. Disadvantageously, though, that leads to uneven shuffle as the tickets, when inserted, are piled up at the bottom of the drum and, during rotation, the tickets placed earlier go back to the bottom of the drum after a full turn, and the tickets placed later on the promotion are kept in the central position and are not practically mixed. As a result, the odds of the earlier tickets being drawn are significantly reduced. In addition, when there is a large number of tickets, shuffling is significantly impaired as there is not enough room for shuffling.

To ensure proper shuffling during the draw an auxiliary apparatus is typically used, such as a plastic swimming pool where the tickets are transferred to from the drum for a later drawing through manual shuffling usually carried out by several people at the same time.

Disadvantageously, regardless of the form of shuffling used, it does not guarantee that all tickets are going to be shuffled, which significantly reduces the chances of all tickets being equally picked out and, also, using a manual shuffling increases the chances of scams, thus corrupting the integrity of the draw.

Aiming at solving the aforementioned problems, the present invention proposes a dynamic and automated device equipped with a rotating drum which, advantageously, comprises mechanisms to feed tickets into it while the drum is rotating and ensure a constant and uniform shuffling of tickets thus making sure of the drawing randomness.

As a result, one of the objects of the present invention is to provide a ticket feeding device without the need for the drum to be stationary, that is, new tickets may be inserted while the drum is rotating.

Another object of the present invention is to provide a swirling mechanism mounted in a proper position in the rotating drum so as to improve shuffling efficiency of the tickets inside the drum.

Advantageously, the swirling mechanism installed in a proper place in the drum further promotes random shuffling of all tickets, in addition to the shuffling generated by the drum's rotation.

Yet another object of the present invention is to provide a lighting system to provide public entertainment and, in addition, a drum made of translucent material for a better viewing of the tickets to be picked out in the device.

Another object of the present invention is to provide a stand conveniently designed to take all the necessary pieces of equipment for the drum's operation thus making up an integral device without the need of installation or mounting at the event venue, except for a single electrical power output.

And yet, advantageously, stand may receive media outlets that provide exposure of marketing campaigns and foster marketing strategies.

BRIEF DESCRIPTION OF THE INVENTION

Briefly, the present invention discloses a device for prize drawings comprising a rotating drum, a stand, a rotation mechanism, a ticket feeding device, a compressed air power unit, and a power, command and control board, including an electronic control unit such as PLC (Programmable Logic Controller).

Rotating drum may further comprise a ticket swirling mechanism interconnected to the compressed air power unit and a lighting system properly associated to the rotating drum.

Schematic figures from a specific embodiment are shown below, the sizes and proportions of which are not necessarily the actual ones because the purpose of such figures is to simply present the several different aspects of the present invention, the scope of which being determined only from the scope of the invention in the attached claims.

DESCRIPTION OF THE INVENTION

As illustrated in the attached drawings, the raffle device (E) comprises a rotating raffle drum (G), a stand (S), a rotation mechanism (R), a ticket feeding device (D), a compressed air power unit (C) and a power, command and control unit (Q), including an electronic control unit (not depicted), such as a PLC.

The rotating raffle drum (G) is a substantially polygonal bin for storing tickets which is closed in one of its ends by panels (G2) interconnected by means of profiles, such as frame rails (G3) thus ensuring the drum's layout (G).

The raffle drum (G) may further comprise a ticket swirling mechanism (T) interconnected to the compressed air power unit (C), and a lighting system (not depicted) conveniently associated to the rotating drum (G).

Figure 1:
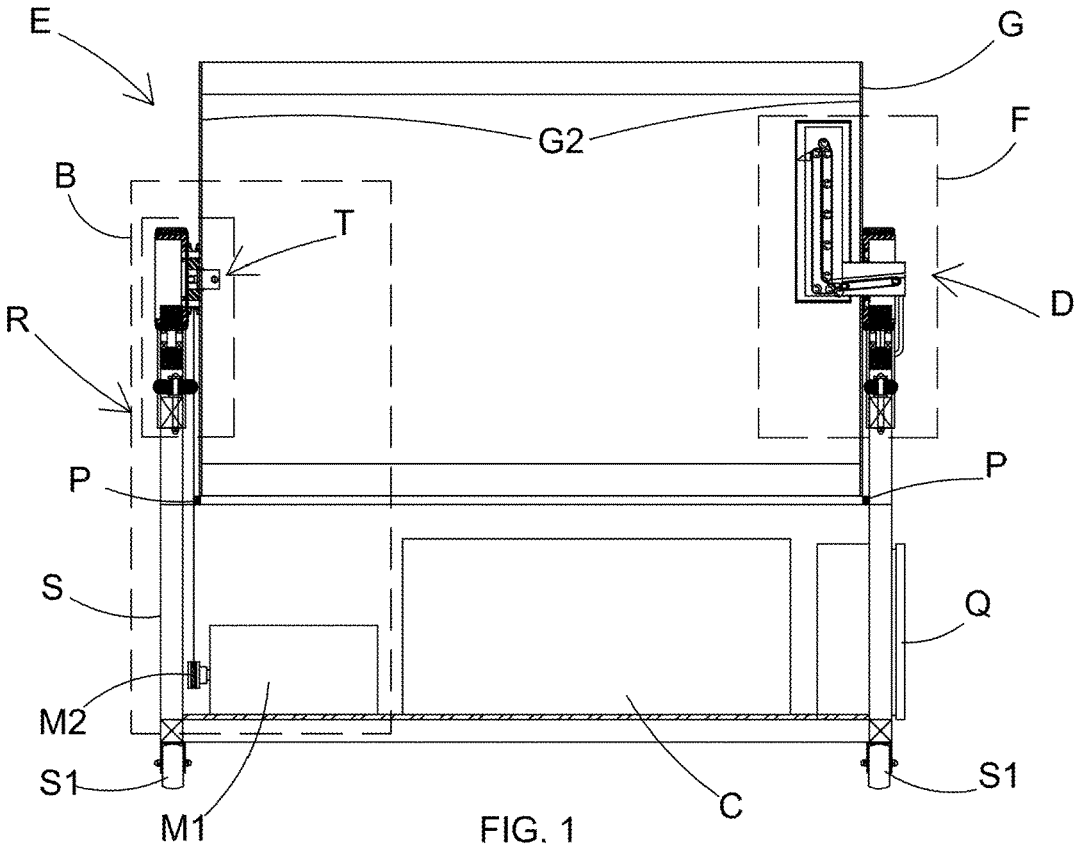
FIG. 1 shows a front schematic view of the raffle device (E) in a preferable embodiment of the present invention.
Figure 2:
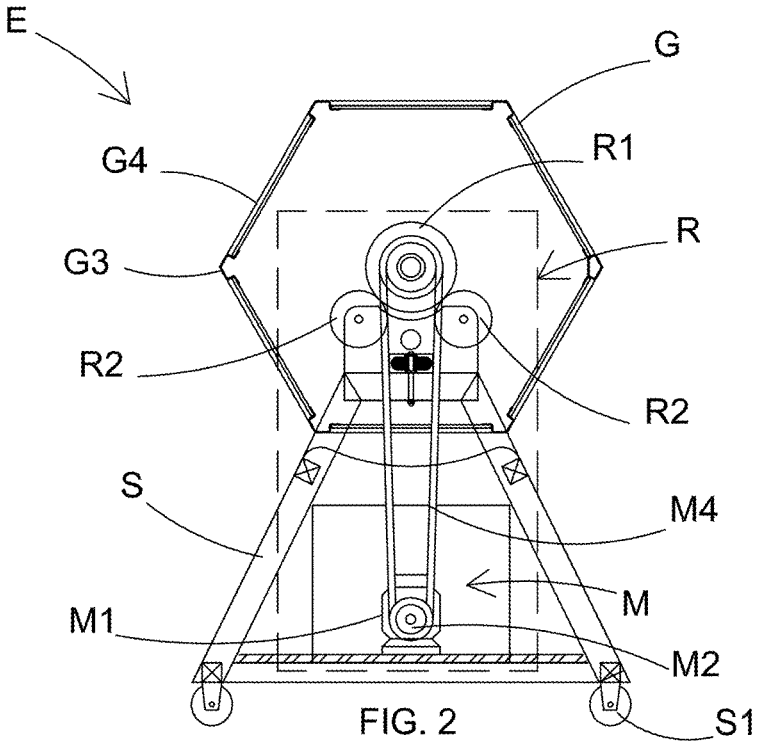
FIG. 2 shows a side schematic view of the raffle device (E) in a preferable embodiment of the present invention.
Figure 3:
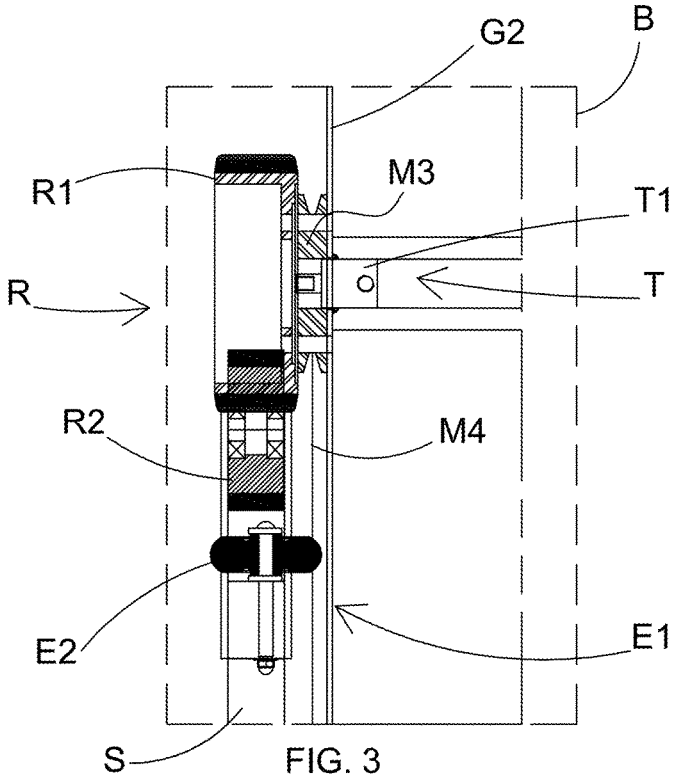
FIG. 3 shows an expanded view of detail B of FIG. 1.

The rotation mechanism (R) of the drum (G), as illustrated in FIGS. 1, 2, and 3, is provided with a set of cooperative wheels (R1) conveniently attached to the panels (G2) center portion, at least one of the wheels (R1) being hollow so as to define a free central portion to feed the tickets even while the drum is in motion, and at least one of the wheels (R1) being actuated by a proper gearbox mechanism (M) to rotate the drum (G).

The device (E) further comprises, on both sides of the drum (G), a set of cooperative wheels (R2) conveniently attached to the stand (S) in an off-center arrangement relative to the wheels (R1) central axis so as to define a bracing for the wheels (R1) at the stand (S) that, besides supporting the drum (G), radially aligns its rotation with respect to the stand (S) central axis.

Preferably, gearbox mechanism (M) spins the drum (G) through a gear motor (M1) associated to a motor pulley (M2) interconnected to a driving pulley (M3) by means of a transmission element such as a belt (M4).

Wheels (R2) are conveniently disposed to anchor the drum (G) during its rotation and, at the same time, ensure a bracing for the wheel (R1) so as to radially align the drum's (G) rotation with respect to the stand (S) central axis.

In an embodiment of the present invention, as illustrated in FIGS. 1, 2, and 3, gear motor (M1) spins the drum (G) by means of the motor pulley (M2) interconnected to the driving pulley (M3) by means of a transmission element (M4) such as a belt cooperating with a wheel (R1) conveniently attached to one of the panels (G2) of the drum (G) in an off-center arrangement.

Figure 4:
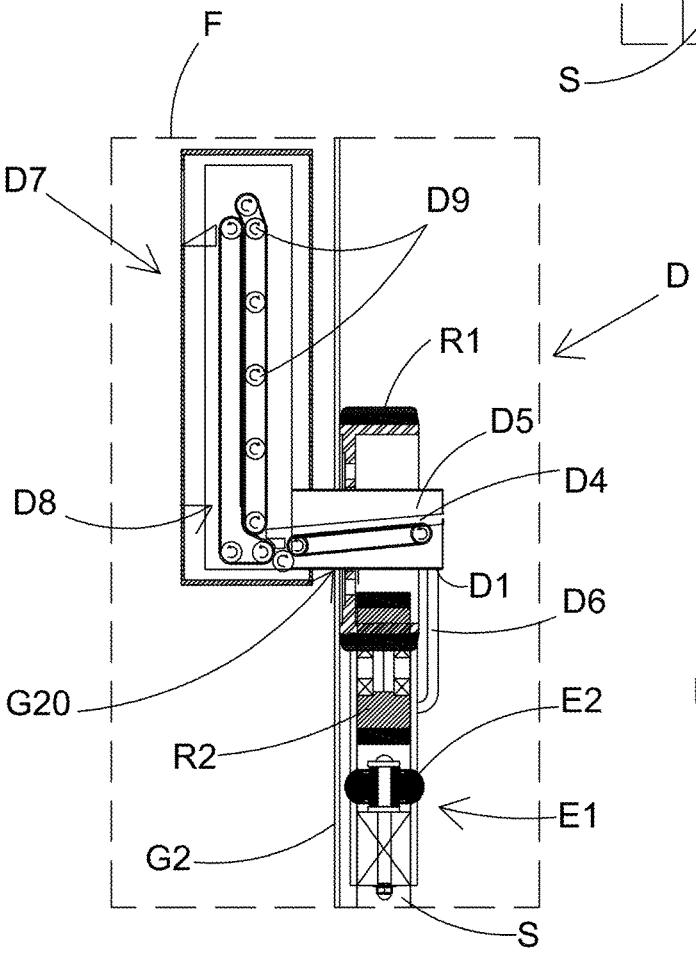
FIG. 4 shows an expanded view of detail F of FIG. 1, in a preferable embodiment of the present invention.

The device (E), as illustrated in FIGS. 3 and 4, comprises at least one auxiliary anchoring device (E1) on both sides of the drum (G), where the wheel (E2) is attached to the stand (S) and in contact with the panel (G2) so that the auxiliary anchoring device (E1) is able to limit the drum (G) axial motion during its rotation.

As illustrated in FIGS. 1, 4, 5, and 6, the ticket feeding device (D) is provided with a duct (D1) arranged on the center region of at least one of the panels (G2) close to an opening (G20) of said panel (G2) and inside at least one of the wheels (R1) which is hollow to define a free center region to feed the tickets even while the drum (G) is in motion.

Figure 4A:
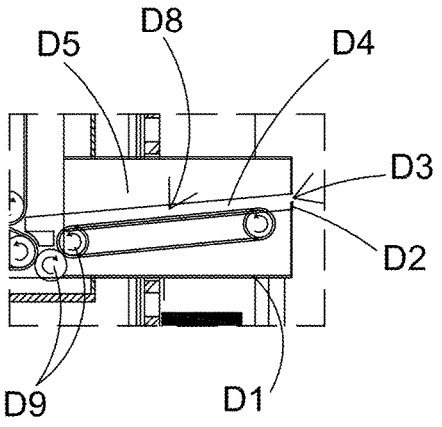
FIG. 4A shows a partial expanded view of FIG. 4.

Preferably, as illustrated in FIGS. 1, 4, and 4A, the ticket feeding device (D) comprises a duct (D1) provided with a channel (D4) partially closed by a wall (D2) so as to form a slot (D3) for inserting the tickets, duct (D1) being provided with a proper J-shaped conveyor (D7) on its inside, which makes it possible to transfer the tickets to the inside of drum (G) at a higher level relative to the duct (D1) central axis by means of proper mechanisms to displace tickets, such as a set of belts, vacuum, air jet or similar mechanisms.

FIGS. 4 and 4A show an example of the appropriate conveyor (D7) comprising a set of micro conveyor belts (D8) and pulleys (D9) associated with one another so as to define a transfer channel for the tickets by friction or mechanical interference, said set of micro conveyor belts (D8) and pulleys (D9) being preferably actuated by a micro gear motor (not depicted).

Advantageously, the conveyor (D7) allows insertion of tickets into the drum (G), even when the number of tickets exceeds the level at the duct (D1) central axis.

Figure 5:
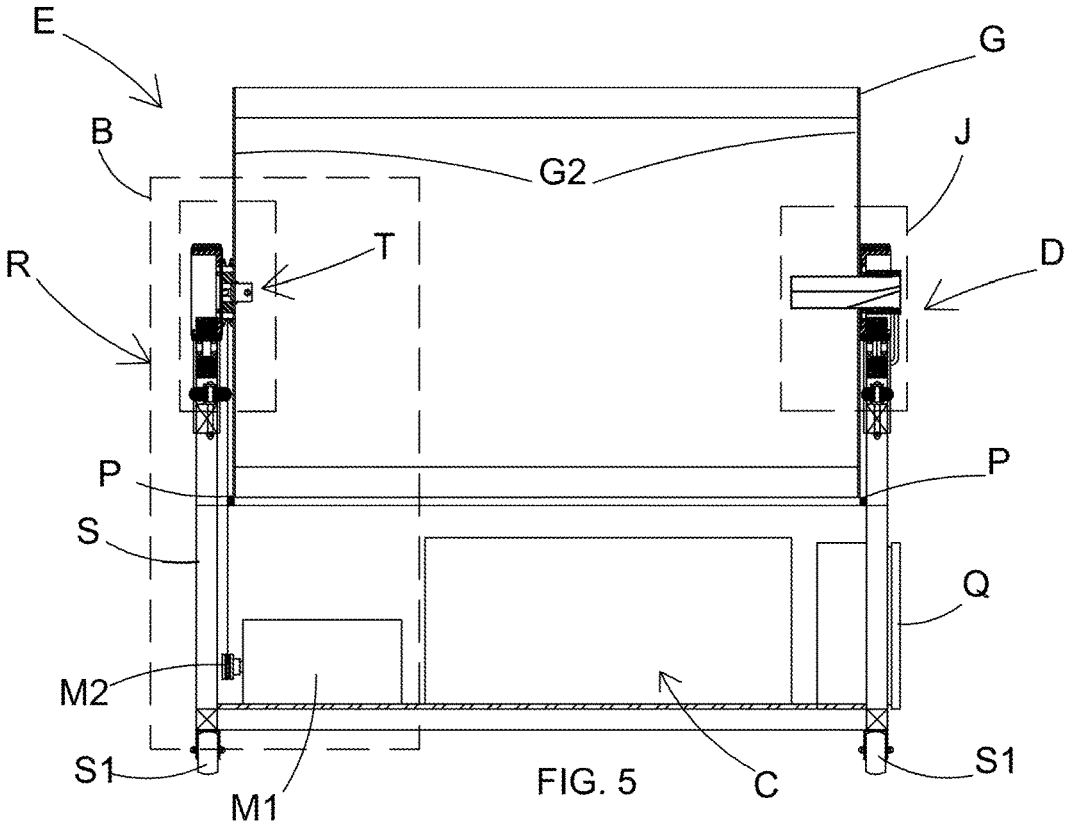
FIG. 5 shows a front schematic view of the raffle device (E), in another embodiment of the present invention.
Figure 6:
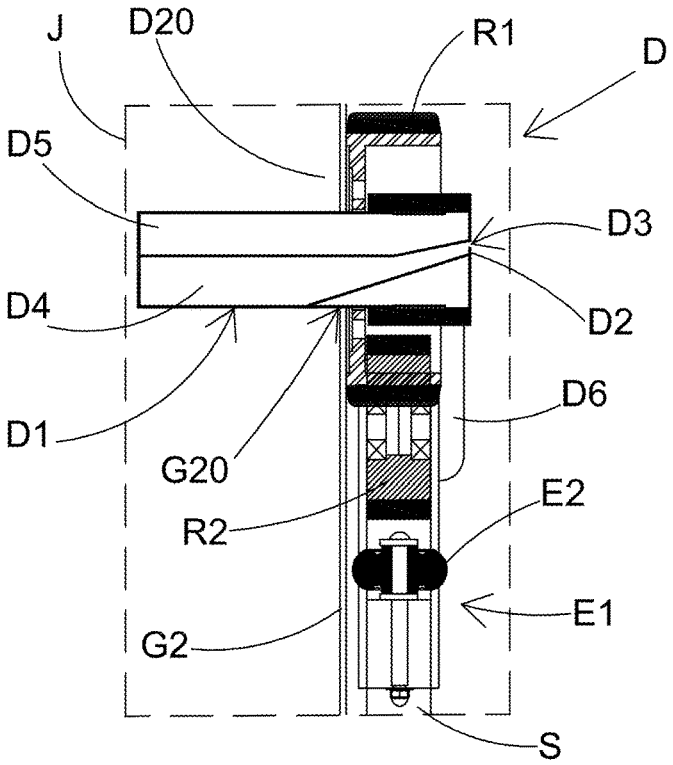
FIG. 6 shows an expanded view of detail J of FIG. 5.

Alternatively, as illustrated in FIGS. 5 and 6, ticket feeding device (D) comprises a duct (D1) provided with a channel (D4) partially closed by a wall (D2) so as to form a slot (D3) to insert tickets. Preferably, channel (D4) is substantially slanted so that tickets, when placed inside thereof, go through said channel (D4) more easily and enters the drum (G).

As a result, ticket falls into the channel (D4) when it is inserted through the slot (D3) by user; the subsequent tickets coming through the slot (D3) are compelled to go through the entire channel (D4) and are then directed into the drum (G). The sequence goes on until the last ticket is inserted.

Optionally, duct (D1) may comprise an air chamber (D5) that accommodates a pipe (D6) connected to the compressed air power unit (C). As a result, to prevent build-up of tickets inside the channel (D4), an injection of air through the air chamber (D5) into the channel (D4) may be pre-programmed by the PLC to release intermittent compressed air jets thus discharging the ticket(s) into the drum (G).

Optionally, after the last ticket is inserted through the slot (D3), the air chamber (D5) releases a compressed air jet into the channel (D4) thus discharging the last ticket into the drum (G), as the movement in the opposite direction, that is, out of the drum (G), is obstructed by the wall (D2).

Optionally, when there is a build-up of tickets inside the channel (D4), a sensor (not depicted) conveniently installed close to said channel (D4), after detecting said build-up, may actuate the air chamber (D5) to release a compressed air jet into the channel (D4) and discharge the ticket(s) into the drum (G).

Despite the preferable use of a ticket feeding device (D), it will be understood that the tickets may be directly inserted into the drum (G) through the duct (D1) arranged on the central region of at least one of the panels (G2) without departing from the scope of the attached claims.

Figure 7:
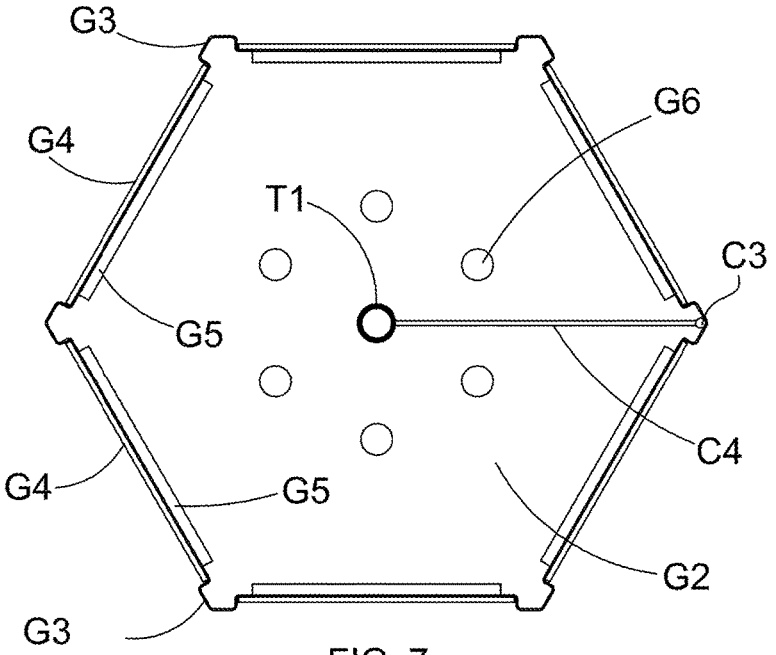
FIG. 7 show a cross-sectional view of a rotating raffle drum (G)

As illustrated in FIGS. 3 and 7, the ticket swirling mechanism (T) is provided with at least one air guiding pipe (C3) and at least one pipe (C4) interconnected to a rotary joint (T1) placed on a panel (G2) on the same side of the rotation mechanism (R). Said ticket swirling mechanism (T) is fed by a compressed air power unit (C) by means of the rotary joint (T1). Pipe (C3) should be placed in the drum (G) and be arranged along one or more frame rails (G3).

Said pipe (C3) is provided with at least one air vent which is supplied by the compressed air power unit (C). Thus, when air is released into the drum (G), it clashes with the tickets and make them swirl.

Preferably, ticket swirling inside the drum (G) takes place automatically and intermittently so as to increase shuffling efficiency.

Further, device (E) comprises at least one safety sensor (not depicted) responsible for monitoring radial motion of drum (G) and at least one safety sensor (not depicted) responsible for monitoring axial motion of drum (G) as well as being responsible for stopping device (E) operation upon rupturing of any of the wheels making up the rotation mechanism (R) or any of the wheels making up the auxiliary anchoring device (E1), so as to avoid greater damage to the device and eventual persons close thereof (E).

As regarding the safety of the people close to the device, especially children, device (E) comprises safety sensors (P) mounted on the stand (S) for immediate stop of drum's (G) rotation by means of the gear motor (M1) shutoff, in case a user puts his or her hand or any object inside the drum (G) during rotation.

Additionally, device (E) may comprise a compressed air feeding point when it is necessary to manually inject compressed air inside the drum (G), as well as at the slot (D3) to make sure there are not tickets inside the ticket feeding device (D).

As illustrated in FIGS. 2 and 7, drum (G) is closed by longitudinal panels (G4) conveniently attached to frame rails (G3) and to profiles (G5), profiles (G5) being arranged between the frame rails (G3) and cooperative with the panels (G2), whose panels (G4) may be attached by any existing means, such as bolts, rivets, stickers of any kind and compatible with the materials used and that can withstand the forces caused by the weight of the tickets and by the inertia of the rotation thereof, among others, so as to form an airtight drum (G). Said longitudinal panels (G4) are preferably made of translucent and resistant material such as polycarbonate or acrylic so as to make it possible to view tickets (not depicted) inside the drum.

Drum (G) may comprise at least one hole (G6) on at least one of the panels (G2) made of translucent and resistant material, such as polycarbonate or acrylic, to form a "lens" appearance so that a brightening effect can take place inside the drum (G) through a lighting system (not depicted) made up by light emission devices (not depicted), preferably RGB devices. Said lighting system (not depicted) generates a strobe effect during drum (G) rotation.

Figure 8:
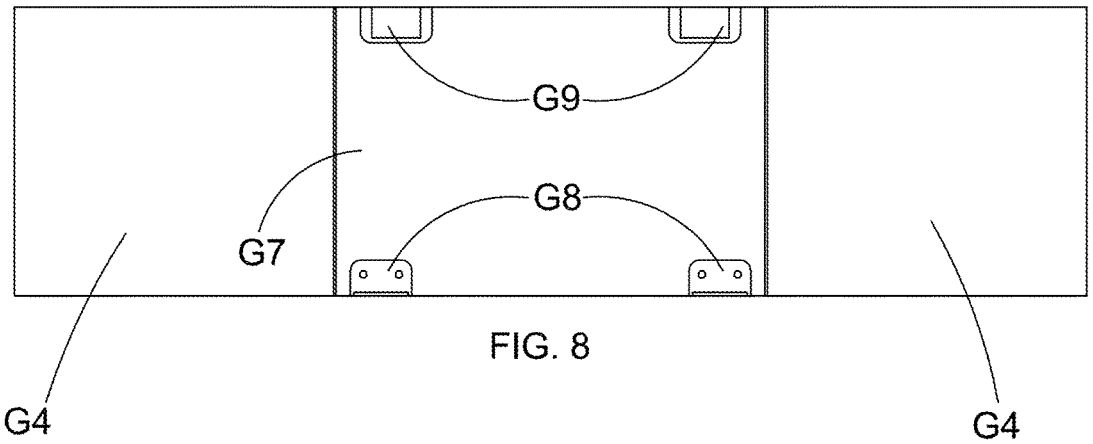
FIG. 8 shows one of the panels (G4) provided with a hatch (G7).

As illustrated in FIG. 8, drum (G) is further provided with at least one hatch (G7) arranged on a panel (G4), hatch (G7) being associated with the drum (G) by means of swiveling elements (G8), such as hinges, and locked by means of at least one lock (G9). Thus, upon conducting the raffle, said lock (G9) ensures the non-violation of the drum (G). Hatch (G7) thus allow a ticket to be picked out as well as the elements inside the drum (G) to be secure.

Stand (S), rotation mechanism (R) on both sides and the ticket feeding device (D) are also provided with protective cowls to prevent people from accessing moving parts and mechanisms of the drum (G) that may cause accidents. Also, stand (S) is provided with casters (S1) to displace the device (E).

Advantageously, stand (S), besides being equipped with all the devices operating the drum (G), can be used to disclose marketing campaigns applied directly to its framework, or stand (S) can also be provided with other media outlets such as back lights, visual displays, sound boxes, or the like, thus fostering marketing strategies.

Device (E) is provided with a power, command and control board (Q) and is preferably controlled by means of a programmable logic controller (PLC) so as to store the operating parameters of the rotation mechanism (R), ticket swirling mechanism (T), compressed air power unit (C), lighting system (not depicted) and the several sensors used. Optionally, device (E) may be manually operated by users.

Preferably, wheels (R1 and R2) are coated with a material resistant to the imposed loads and, at the same time, rubberized to eliminate noises caused by friction during rotation while using device (E). Wheels (E2) must be provided with mechanical resistance and non-staining properties as they contact the sides of the drum (G2).

Variations and modifications with respect to the embodiments shows and described in the attached drawings will readily occur to a person skilled in the art without departing from the scope of the invention as defined in the attached claims.

The invention claimed is:

1. A RAFFLE DEVICE, comprising: a rotating raffle drum (G) for storing tickets, two opposite ends of the rotating raffle drum (G) being closed by panels (G2), respectively, the rotating raffle drum (G) being supported by a stand (S); a rotation mechanism (R) provided with a set of cooperative wheels (R1, R2) wherein the wheels (R1) are mounted to a central portion of the panels (G2), and wheels (R2) are mounted to the stand (S), and at least one wheel (R1) being hollow, the rotation mechanism (R) including at least a gearbox mechanism (M) which is mounted on at least one panel (G2) which closes one end of the two opposite ends of the rotating raffle drum (G), the at least one wheel (R1) being actuated by a gearbox mechanism (M) to rotate the drum (G); wherein the set of cooperative wheels (R2), on both sides of the drum (G), mounted to the stand (S) in an off-center arrangement relative to the wheel (R1) central axis so as to define a bracing for the wheels (R1) that, besides supporting the drum (G), radially aligns its rotation relative to the stand (S) central axis and a ticket feeding device (D) provided with a duct (D1) arranged inside the at least one wheel (R1) and the ticket feeding device (D) being mounted on a central region of at least one of the panels (G2) of the drum (G).

2. The RAFFLE DEVICE according to claim 1, wherein tickets are inserted into the drum (G) when drum (G) is in motion.

3. The RAFFLE DEVICE according to claim 1, wherein the set of cooperative wheels (R1, R2) are coated with a material resistant to an imposed load by the tickets and, at the same time, rubberized to eliminate noises caused by friction during rotation while using a device (E).

4. The RAFFLE DEVICE according to claim 3, the device (E) further comprising at least one safety sensor responsible for monitoring radial motion of the drum (G) and at least one safety sensor responsible for monitoring axial motion of the drum (G).

5. The RAFFLE DEVICE" according to claim 1, wherein the duct (D1) comprises a channel (D4) slanted mounted and partially closed by a wall (D2) so as to form a slot (D3) for inserting tickets.

6. The RAFFLE DEVICE according to claim 5, wherein the ticket feeding device (D) comprises an air chamber (D5) that accommodates a pipe (D6) connected to a compressed air power unit (C) to inject air into the channel (D4).

7. The RAFFLE DEVICE according to claim 5, further comprising a sensor installed close to the channel (D4) to actuate the air chamber (D5) and release a compressed air jet into the channel (D4) so as to discharge the ticket(s) into the drum (G).

8. The RAFFLE DEVICE according to claim 1, wherein the duct (D1) is provided with a conveyor (D7) on its inside to transfer tickets to an inside of drum (G) in a higher level relative to the duct (D1) central axis.

9. The RAFFLE DEVICE according to claim 8, wherein the conveyor (D7) comprises a set of micro conveyor belts (D8) and pulleys (D9) associated with one another so as to define a transfer channel for the tickets by friction or mechanical interference or similar, the set of conveyor belts (D8) and pulleys (D9) being actuated by a micro gear motor.

10. The RAFFLE DEVICE according to claim 9, wherein the conveyor (D7) is of J-shaped and is configured in such a way to displace tickets by means of a set of belts, vacuum, or air jet.

11. The RAFFLE DEVICE according to claim 1, wherein the gearbox mechanism (M) comprises a gear motor (M1) associated to a motor pulley (M2) connected to a driving pulley (M3) by means of a transmission element (M4).

12. The RAFFLE DEVICE according to claim 1, further comprising: on both sides of drum (G), at least one auxiliary anchoring device (E1) made up by a wheel (E2) mounted to the stand (S) and in contact with a panel (G2) so as to limit drum's (G) axial motion during rotation.

13. The RAFFLE DEVICE according to claim 1, further comprising at least one lighting system, which is a RGB device.

14. The RAFFLE DEVICE according to claim 1, further comprising safety sensors (P) mounted on the stand (S) for immediate stop of the drum's (G) rotation by means of the gear motor (M1) shutoff.

15. The RAFFLE DEVICE according to claim 1, wherein drum (G) is of polygonal shaped closed on its ends by panels (G2) and longitudinally closed by panels (G4) mounted to frame rails (G3) and profiles (G5), profiles (G5) being arranged between frame rails (G3) and cooperative with the panels (G2).

16. The RAFFLE DEVICE according to claim 15, wherein the panels (G4) are made of translucent and resistant material so as to make it possible to view tickets inside the drum.

17. The RAFFLE DEVICE according to claim 15, wherein the drum (G) comprises at least one hatch (G7) arranged on one of the panels (G4), mounted with the drum (G) by means of swiveling elements (G8) and locked by means of at least one lock (G9).

18. The RAFFLE DEVICE according to claim 1, wherein the stand (S), rotation mechanism (R) and ticket feeding device (D) are provided with protective cowls.

19. The RAFFLE DEVICE according to claim 1, further comprising: a power, command and control board (Q) controlled by means of a programmable logic controller (PLC) so as to store the operating parameters of the rotation mechanism (R), ticket swirling mechanism (T), compressed air power unit (C) and lighting system.

20. The RAFFLE DEVICE according to claim 1, wherein the stand (S) comprises advertising campaign medias or other media outlets such as back lights, visual displays, sound boxes.

* * * * *